US006264190B1

(12) United States Patent
Aoki

(10) Patent No.: US 6,264,190 B1
(45) Date of Patent: Jul. 24, 2001

(54) SUCTION UNIT IN SHEET-FED ROTARY PRINTING PRESS

(75) Inventor: Takanobu Aoki, Ibaragi (JP)

(73) Assignee: Komori Corporation (JP)

( * ) Notice: Subject to any disclaimer, the term of this patent is extended or adjusted under 35 U.S.C. 154(b) by 0 days.

(21) Appl. No.: 09/397,406

(22) Filed: Sep. 16, 1999

(30) Foreign Application Priority Data

Sep. 16, 1998 (JP) ..... 10-261886
Sep. 16, 1998 (JP) ..... 10-261905

(51) Int. Cl.[7] ..... B65H 29/68
(52) U.S. Cl. ..... 271/183; 271/194
(58) Field of Search ..... 271/183, 194

(56) References Cited

U.S. PATENT DOCUMENTS 2,474,997 * 7/1949 Wormser ..... 271/183
4,085,930 * 4/1978 Weisgerber et al. ..... 271/183 X
4,878,658 * 11/1989 Pollich ..... 271/183

FOREIGN PATENT DOCUMENTS 944 857 6/1956 (DE) .
28 11 963 3/1978 (DE) ..... B65H/29/68
2811963 * 9/1979 (DE) ..... 271/183
34 13 179 4/1984 (DE) ..... B65H/43/00
40 35 036 11/1990 (DE) ..... B65H/29/68
0 178 470 9/1985 (EP) ..... B65H/29/68
0 693 449 6/1995 (EP) ..... B65H/29/68
1 592 001 11/1996 (FR) .
662947 * 12/1951 (GB) ..... 271/183

* cited by examiner

*Primary Examiner*—David H. Bollinger
(74) *Attorney, Agent, or Firm*—Blakely Sokoloff Taylor & Zafman

(57) ABSTRACT

A suction unit in a sheet-fed rotary printing press includes a plurality of suction wheels, a plurality of supports, a drive shaft, a motor, a shaft, a coupling, a bearing, a sleeve, and a gear, and a knob and a screw. The suction wheels are provided below a sheet convey path to draw a sheet-like printing product in a slidable contact by suction. The supports support the suction wheels to be movable in a sheet convey direction. The drive shaft, motor, shaft, coupling, bearing, sleeve, and gear drive the suction wheels in the sheet convey direction. The knob and screw detachably fix the suction wheels to the supports. The suction wheels are connected to/disconnected from the drive shaft, motor, shaft, coupling, bearing, sleeve, and gear when the suction wheels are fixed to/released from the supports by the knob and screw.

13 Claims, 7 Drawing Sheets

SUCTION UNIT IN SHEET-FED ROTARY PRINTING PRESS

BACKGROUND OF THE INVENTION

The present invention relates to a suction unit provided to a delivery unit in a sheet-fed rotary printing press, which draws a printing product being conveyed in a slidable contact state by suction, and decelerates it.

In a sheet-fed rotary printing press, a printing product (to be referred to as a sheet hereinafter) printed by a printing unit is transferred from the grippers of an impression cylinder to the grippers of delivery chains, conveyed, released from the grippers at a convey terminal end, and dropped onto a pile board and stacked there. In this delivery unit, as the sheet to be conveyed is merely gripped at its leading end by the grippers, the trailing end of the sheet may flap. When the gripped sheets are released and dropped, the ends of the stacked sheets may not be aligned since traveling inertia remains in the sheets.

In order to prevent this, a countermeasure is proposed as shown in Japanese Utility Model Publication No. 7-26288. According to this reference, a plurality of suction wheels each having suction surfaces are aligned near the convey terminal end in the widthwise direction of the sheet (a direction perpendicular to the convey direction). A sheet released from grippers is attached to the surfaces of the suction wheels so that the sheet convey speed is decreased. In this suction unit, the suction wheels that rotate at a peripheral velocity lower than the printed sheet convey speed are formed upstream of the delivery unit in the delivery direction. The suction surfaces connected to a suction air source are formed in the circumferential surfaces of the suction wheels to draw a sheet by suction while coming into slidable contact with the sheet.

When the suction unit having the above arrangement is used in a perfector, if the suction wheels are arranged at positions corresponding to an image printed on the lower surface of the sheet, the suction surfaces of the suction wheels damage the image printed on the sheet to degrade the printing quality. For this reason, the suction wheels must be arranged to correspond to non-image areas where an ink is not attached to the sheet. In the non-image areas, the number of images changes depending on plate making for the image (image assignment in the widthwise direction of the sheet). Accordingly, the number of suction wheels must also be changed in accordance with the number of images.

In the conventional suction unit of the sheet-fed rotary printing press, since a drive shaft extends through the suction wheels, the suction wheels cannot be removed from the drive shaft. If some wheels may not be used as the result of a change in image plate making, unnecessary suction wheels must be moved to the outer side of the sheet width, which is cumbersome.

In a printing press serving as both a perfecter and a single-sided printing press, when double-sided printing is to be performed, suction wheels each having a width smaller than the width of a non-image area are required. In single-sided printing, when high-speed printing is to be performed on a thick sheet, wide suction wheels having a large suction force are required. When these suction wheels are required, the entire assembly of the suction wheel is exchanged. Alternatively, both suction wheels required for double-sided printing and single-sided printing are mounted in the suction wheel assembly, and an unnecessary suction wheel is moved outside the sheet in the sheet widthwise direction, as described above.

SUMMARY OF THE INVENTION

It is an object of the present invention to provide a suction unit in a sheet-fed rotary printing press, the position and number of which can be changed easily in accordance with a change in number and position of non-image areas.

In order to achieve the above object, according to the present invention, there is provided a suction unit in a sheet-fed rotary printing press, comprising a plurality of suction members provided below a sheet convey path to draw a sheet-like printing product in a slidable contact by suction, a plurality of support members for supporting the suction members to be movable in a sheet convey direction, a drive mechanism for driving the suction members in the sheet convey direction, and a fixing member for detachably fixing the suction members to the support members, wherein the suction members are connected to/disconnected from the drive mechanism when the suction members are fixed to/released from the support members by the fixing member.

DESCRIPTION OF THE PREFERRED EMBODIMENT

The present invention will be described in detail with reference to the accompanying drawings.

Figure 1:
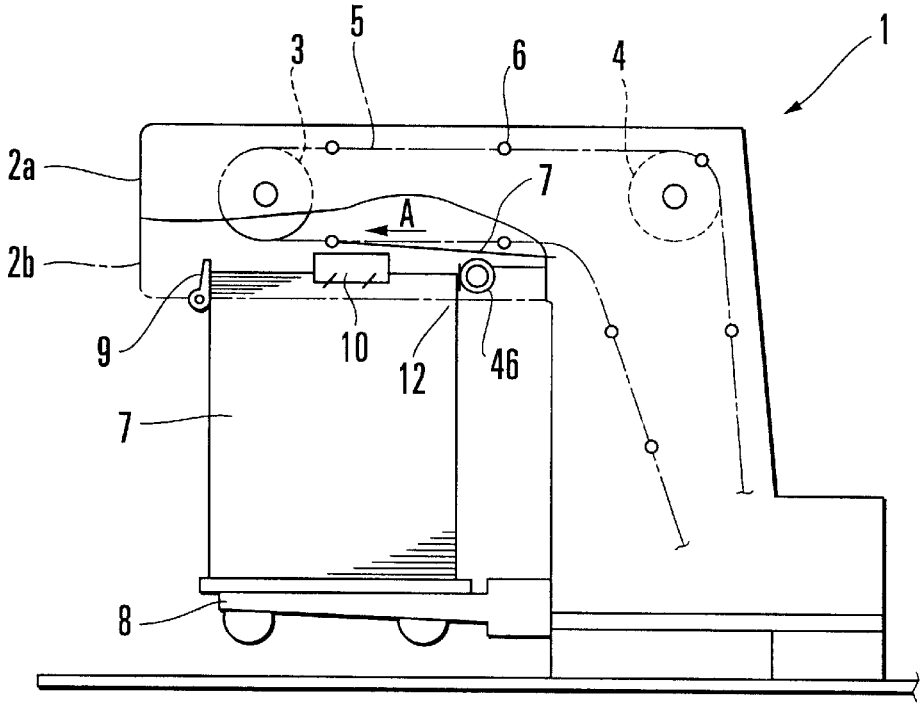
FIG. 1 is a side view schematically showing a delivery unit for a sheet-fed rotary printing press.

FIG. 1 shows a delivery unit in a sheet-fed rotary printing press according to an embodiment of the present invention. Referring to FIG. 1, a pair of sprockets 3 are rotatably provided to the rear portion, in the sheet convey direction, of a pair of opposing frames 2*a* and 2*b* of a delivery unit 1. A pair of sprockets 4 are rotatably provided to the front portion, in the sheet convey direction, of the frames 2*a* and 2*b*. A pair of delivery chains 5 extend between the sprockets 3 and 4.

Gripper bars 6 extend between the delivery chains 5 at a predetermined pitch. Each gripper bar 6 is provided with a gripper unit (not shown) composed of a gripper and a gripper pad. In this arrangement, as the delivery chains 5 travel, a sheet 7 printed by the printing apparatus main body is conveyed in a direction of an arrow A as it is gripped by the gripper units. At the convey terminal end, the sheet 7 is released from the gripper units and dropped onto a pile board 8 to be stacked on it. The sheets 7 dropped and stacked on the pile board 8 are aligned in the vertical direction by abutting their leading ends against a paper lay 9, and in the horizontal direction by a side jogger plate 10. A suction unit 12 is provided upstream of the convey terminal end of the delivery unit 1 to reduce the traveling inertia of the sheet 7 under transfer to the pile board 8.

Figure 2A:
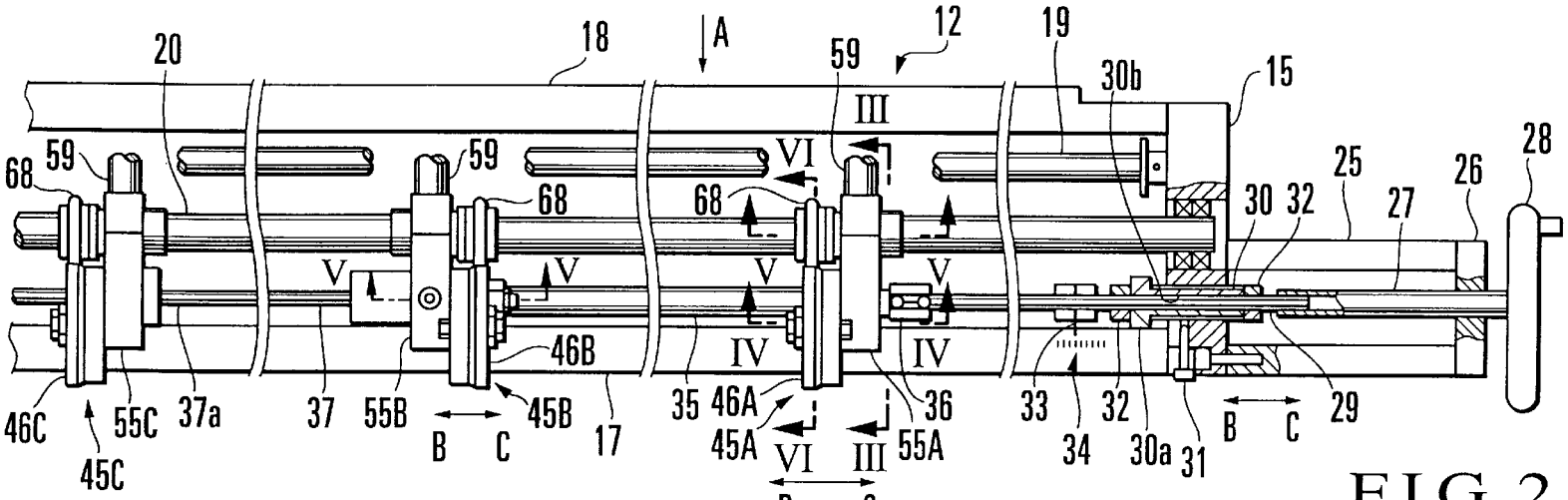
FIGS. 2A and 2B are plan views respectively showing the right and left halves of a suction unit in a sheet-fed rotary printing press according to an embodiment of the present invention.
Figure 2B:
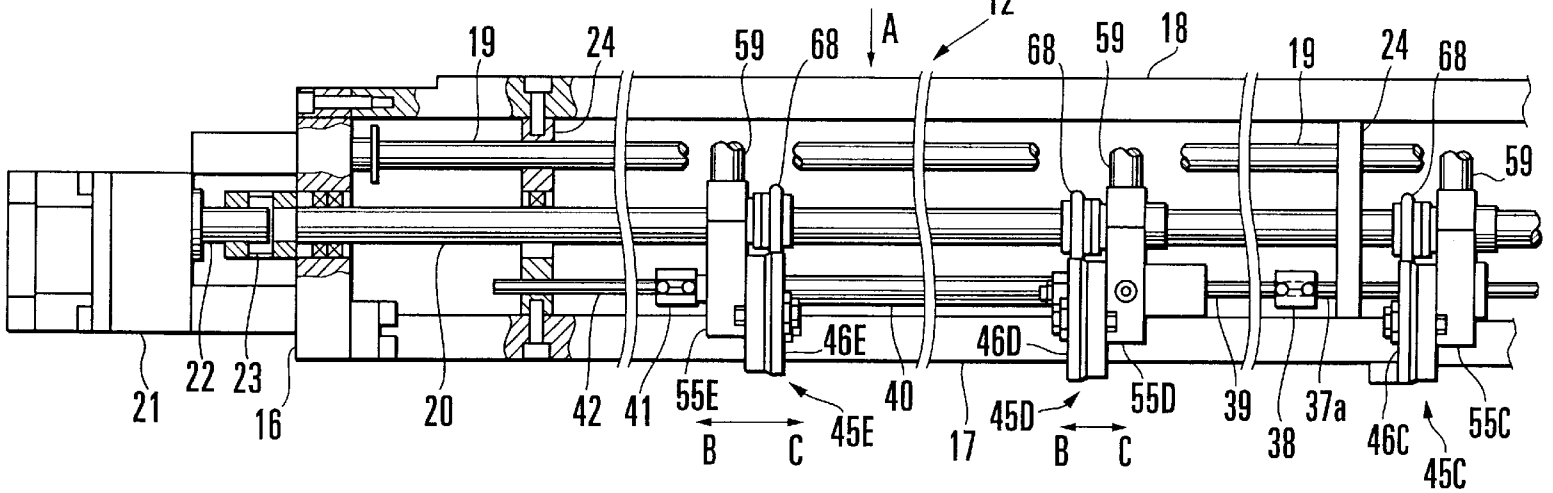

The suction unit 12 will be described with reference to FIGS. 2A and 2B.

The suction unit 12 is provided with a pair of opposing frames 15 and 16. A pair of stays 17 and 18 extend between the frames 15 and 16, and a shaft 19 also horizontally extends between the frames 15 and 16. The shaft 19 is rotated by a drive unit (not shown) to move the suction unit 12 in the vertical direction of the sheet 7. A shaft 22 of a motor 21 fixed to the frame 16 is connected, through a coupling 23, to the projecting end, projecting from the frame 16, of a drive shaft 20 rotatably supported between the frames 15 and 16. A support 24 extending between the stays 17 and 18 supports the shaft 19 and rotatably, axially supports the drive shaft 20 through a bearing.

A support plate 26 is attached to the outer side of the frame 15 through studs 25, and a cylindrical operation shaft 27 is rotatably supported by the support plate 26. A handle 28 is axially mounted on one end of the operation shaft 27 which projects from the support plate 26, and one end of a connecting shaft 29 is fitted in and fixed to the other end of the operation shaft 27. When a head 30*a* of an operation shaft movement adjusting member 30 threadably engaging with the threaded portion of the frame 15 is rotated with a spanner or the like, all the suction wheels move at once in a direction of arrows B–C. Movement of the operation shaft movement adjusting member 30 is regulated by urging the distal end of a set screw 31 against the threaded portion on the surface of the operation shaft movement adjusting member 30.

The connecting shaft 29 is rotatably supported in a through hole 30*b* extending through the operation shaft movement adjusting member 30 in the axial direction. A pair of rings 32 are axially mounted on the connecting shaft 29 to sandwich the two ends of the operation shaft movement adjusting member 30, thereby regulating the movement of the connecting shaft 29 in the axial direction (the direction of the arrows B–C). A pointer 33 is attached to the connecting shaft 29 such that it moves together with the connecting shaft 29 when the connecting shaft 29 moves in the axial direction, while it is rotatable when the connecting shaft 29 moves in the rotating direction. A scale 34 is formed on the stay 17 to correspond to the distal end of the pointer 33.

The other end of the connecting shaft 29 is connected to one end of a first screw rod 35 through a connecting member 36. The axis of the first screw rod 35 coincides with that of the connecting shaft 29. The first screw rod 35 rotates together with the connecting shaft 29. The other end of the first screw rod 35 is connected to one end of a second screw rod 37. The axis of the second screw rod 37 coincides with that of the first screw rod 35. The second screw rod 37 rotates together with the first screw rod 35. The other end of a shaft portion 37*a*, which corresponds to a portion of the second screw rod 37 extending from substantially its center to the other end not formed with a threaded portion, is connected to one end of a third screw rod 39 through a connecting member 38. The axis of the third screw rod 39 coincides with that of the shaft portion 37*a*. The third screw rod 39 rotates together with the shaft portion 37*a*.

The other end of the third screw rod 39 is connected to one end of a fourth screw rod 40. The axis of the fourth screw rod 40 coincides with that of the third screw rod 39. The fourth screw rod 40 rotates together with the third screw rod 39. The other end of the fourth screw rod 40 is connected to one end of a shaft 42 through a connecting member 41. The axis of the shaft 42 coincides with that of the fourth screw rod 40. The shaft 42 rotates together with the fourth screw rod 40.

The shaft 42, the shaft portion 37*a* of the second screw rod 37, and the connecting shaft 29 are rotatably supported through the support 24 extending between the stays 17 and 18, and another support (not shown). The pitches of the first and fourth screw rods 35 and 40 located on two end sides of the frames 15 and 16 are set to be substantially twice those of the second and third screw rods 37 and 39, respectively, located at the center of the frames 15 and 16. The first and second screw rods 35 and 37 form right-hand threads, and the third and fourth screw rods 39 and 40 form left-hand screws.

Four suction wheel units 45A, 45B, 45D, and 45E, and one suction wheel unit 45C are axially mounted on the first to fourth screw rods 35, 37, 39, and 40, and the shaft portion 37*a* of the second screw rod 37, respectively. The suction wheel units 45A to 45E have the same structure.

Figure 4:
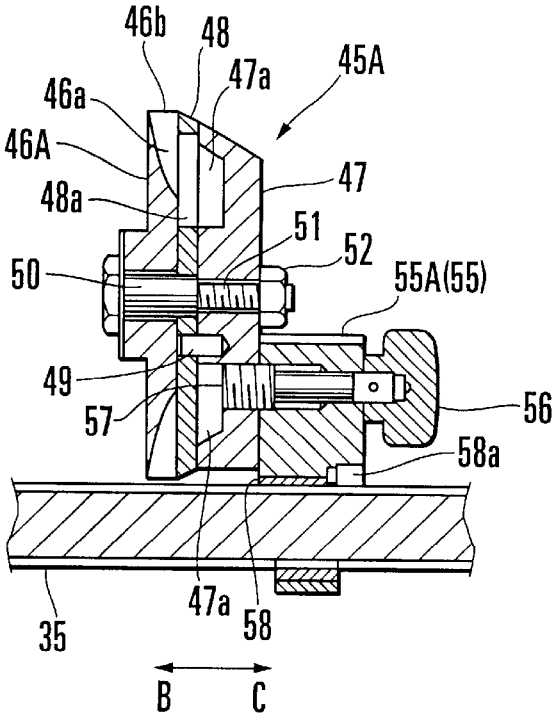
FIG. 4 is a sectional view taken along the line IV—IV of FIG. 2A.

The structure of the suction wheel unit 45A will be described with reference to FIG. 4. Referring to FIG. 4, the suction wheel unit 45A is constituted by a suction wheel 46A, a duct 47, and a lid 48 interposed between the duct 47 and suction wheel 46A. The suction wheel 46A is formed with a large number of slit-like air paths 46*a* in the rotational direction of the suction wheel 46A at the equal pitch. One side surface and a circumferential end face of each air path 46*a* are open. The openings in the circumferential end face of the suction wheel 46A form suction holes 46*b*. The large number of suction holes 46*b* are formed in the circumferential surface of the suction wheel 46A at the equal pitch.

The lid 48 is made of a flat plate having substantially the same outer diameter as the outer diameter of the suction wheel 46A, and a window 48*a* having a semicircular shape when seen from the side surface is formed in the upper portion of the lid 48. The duct 47 is formed with a hollow portion 47*a* having one side surface that opens to the lid 48.

In this structure, the lid 48 is fixed to the duct 47 with a set screw 49 such that its window 48*a* opposes the hollow portion 47*a*. A screw 51 is fitted in the center hole of the suction wheel 46A through a sleeve 50, and the screw 51 extends also through the center hole of the duct 47. When a nut 52 is threadably engaged with the screw 51, the suction wheel 46A is rotatably supported by the duct 47 through the sleeve 50. The suction wheel unit 45A is fixed to a support 55A with a screw 57 having a knob 56. A through hole 55*b*, through which the drive shaft 20 extends through a sleeve 62, is formed in the support 55A.

Figure 3:
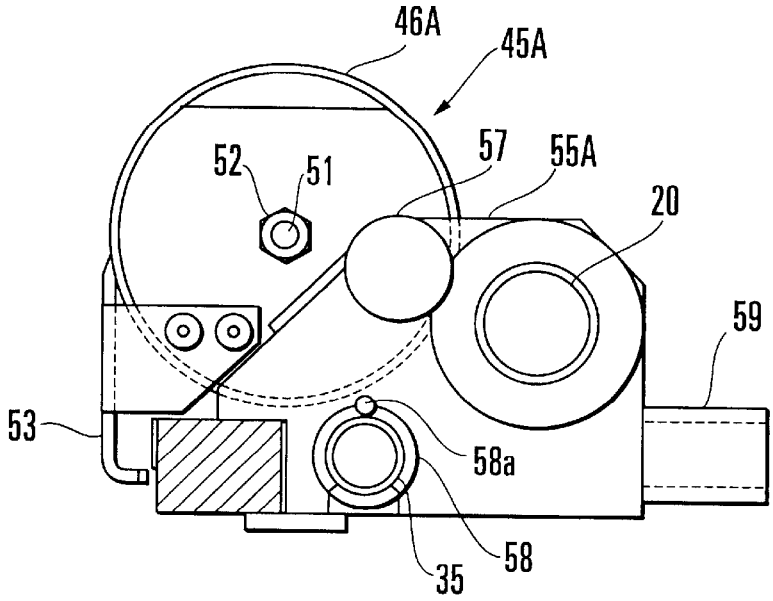
FIG. 3 is a sectional view taken along the line III—III of FIG. 2A.

As shown in FIG. 3, a bush 58 formed with a threaded portion to threadably engage with the first screw rod 35 is fitted on and fixed to the support 55A such that its circumferential movement is regulated by a rotation preventive member 58*a*. A paper guide 53 is screwed to the duct 47.

The second, third, and fourth screw rods 37, 39, and 40 respectively threadably engage with the threaded portions of bushes 58 of supports 55B, 55D, and 55E of the suction wheel units 45B, 45D, and 45E. A through hole (not shown) where the shaft portion 37*a* of the second screw rod 37 is to be inserted is formed in a support 55C of the central suction wheel unit 45C.

Figure 5:
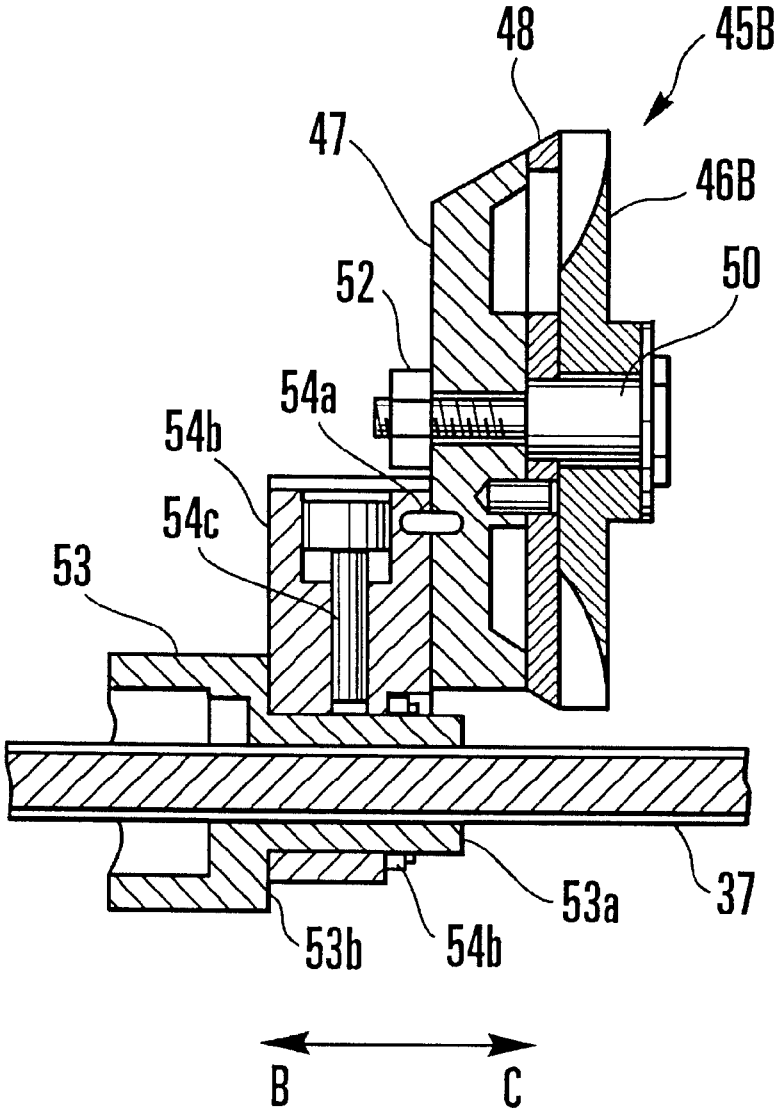
FIG. 5 is a sectional view taken along the line V—V of FIG. 2A.

The arrangement of the suction wheel unit 45B will be described with reference to FIG. 5. The suction wheel unit 45D is identical to the suction wheel unit 45B.

The suction wheel unit 45B is different from the suction wheel unit 45A in that the suction wheel unit 45B can be adjusted to be movable in the direction of the arrows B–C. Referring to FIG. 5, a pivotal member 53 formed with a small-diameter portion 53*a* threadably engages with the second screw rod 37. A support 54B is integrated with the duct 47 by a set screw 54*a*. The small-diameter portion 53*a* of the paper guide 53 extends through a through hole formed in the lower portion of the support 54B. This support 54B is sandwiched by a removal preventive ring 54*b* and a step 53*b* of the pivotal member 53, and moves together with the pivotal member 53 in the direction of the arrows B–C.

A bolt 54*c* threadably engages with the support 54B. The pivotal member 53 is fixed to the support 54B by screwing the bolt 54*c*. When the bolt 54*c* is loosened, the pivotal member 53 can pivot. When the pivotal member 53 is pivoted, the suction wheel unit 45B is movably adjusted in the direction of the arrows B–C through the support 54B.

Figure 6A:
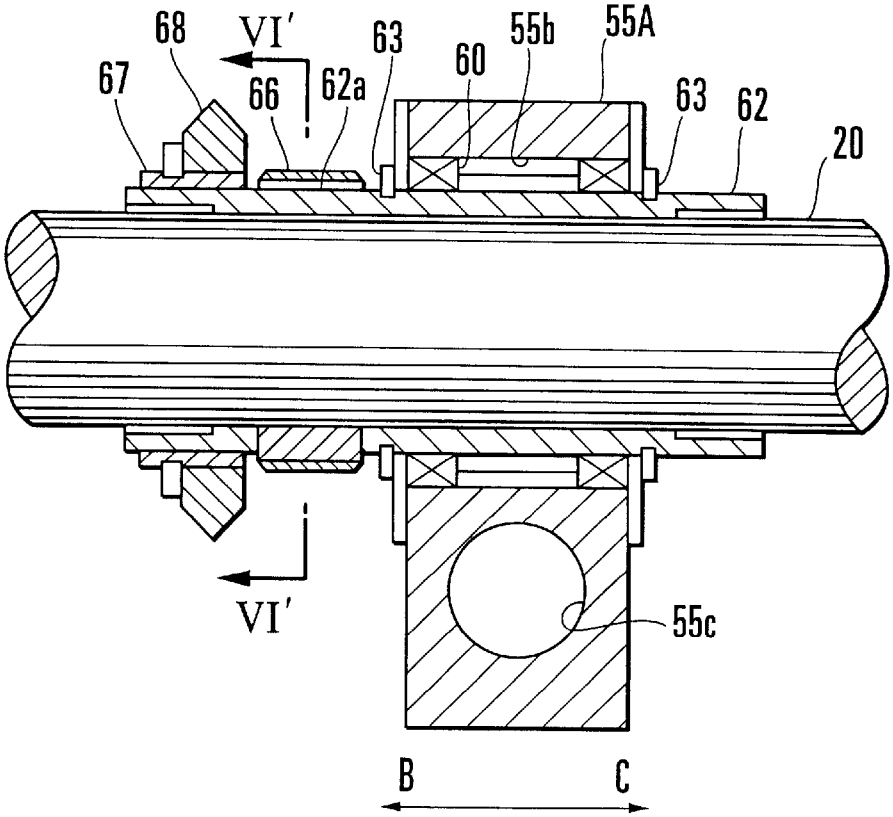
FIG. 6A is a sectional view taken along the line V'—V' of FIG. 2A.

As shown in FIG. 6A, a hollow portion 55*c* extending in the back-and-forth direction of the sheet is formed in the lower portion of the support 55A. One end side of the hollow portion 55*c* communicates with the hollow portion 47*a* of the duct 47. An opening formed at the other end side of the support 55C is connected to one end of a hose 59 which is connected to a suction air source (not shown) at its other end. Namely, the air paths 46*a* of the suction wheel 46A, the window 48*a* of the lid 48, the hollow portion 47*a* of the duct 47, the hollow portion 55*c* of the support 55A, and the hose 59 communicate with each other.

Therefore, the outer air near the suction holes 46*b* of the suction wheel 46A is drawn by the suction air source through the air paths 46*a*, the window 48*a*, the hollow portion 47*a* of the duct 47, the hollow portion 55*c* of the support 55A, and the hose 59, to attract the sheet 7 by the circumferential surface of the suction wheel 46A.

The hose 59 is made of a flexible member and connected to the suction air source with a margin. Accordingly, even when the suction wheel unit 45A is moved as will be described later, the hose 59 is kept connected to the suction air source.

A structure for rotatably driving the suction wheel 46A will be described with reference to FIGS. 6A and 6B, and FIG. 7.

As shown in FIG. 6A, the diameter of the through hole 55*b* of the support 55A is larger than the diameter of the drive shaft 20, and a bearing 60 is arranged in the through hole 55*b*. The sleeve 62 fitted on the drive shaft 20 has a two-forked portion on which a spring 66 is wound. As shown in FIG. 6B, these portions constitute a pair of arcuate rotation transmitting portions 62*a* opposing each other. The sleeve 62 is inserted in the through hole 55*b* of the support 55A through the bearing 60. The support 55A is sandwiched by a pair of removal preventive rings 63 fixed to the sleeve 62, to regulate the axial movement of the sleeve 62 with respect to the support 55A.

Figure 6B:
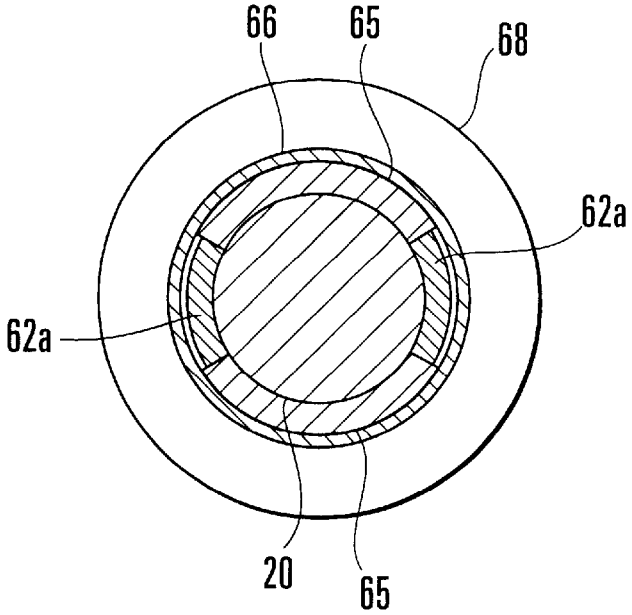
FIG. 6B is a sectional view taken along the line VI'—VI' of FIG. 6A.

As shown in FIG. 6B, a pair of arcuate holders 65 having an outer diameter slightly larger than the outer diameter of the rotation transmitting portions 62*a* are interposed between the rotation transmitting portions 62*a* of the sleeve 62. The spring 66 is wound on the holders 65 to press them against the drive shaft 20 with its fastening force. Since the spring 66 fastens the holders 65, the holders 65 integrally rotate to follow rotation of the drive shaft 20. As the holders 65 rotate, the pair of rotation transmitting portions 62*a* also rotate to transmit rotation of the drive shaft 20 to the sleeve 62.

Figure 7:
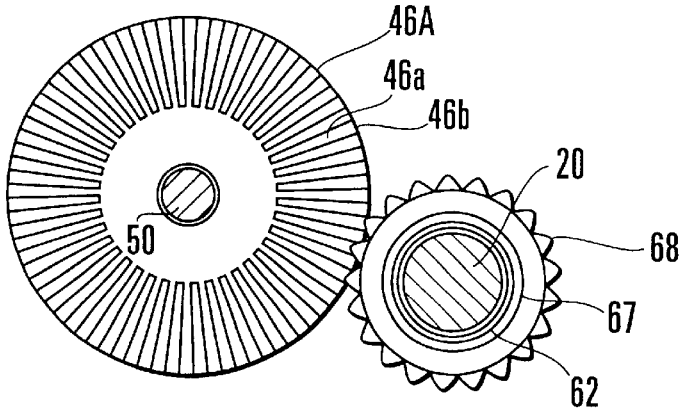
FIG. 7 is a sectional view taken along the line VI—VI of FIG. 2A.

As shown in FIG. 7, a gear 68 which rotates together with the sleeve 62 is fitted on and fixed to one end of the sleeve 62 through a bush 67. The gear 68 having teeth at the same pitch as that of the suction holes 46*b* of the suction wheel 46A meshes with the suction holes 46*b*. When the drive shaft 20 is rotated by the motor 21, the gear 68 rotates through the holders 65 and sleeve 62, so that the suction wheel 46A also rotates about the sleeve 50 as the rotation center, as shown in FIG. 4.

In this case, the outer diameter of the rotation transmitting portions 62*a* of the sleeve 62 is smaller than the outer diameter of the holders 65. Therefore, the sleeve 62 is supported to be movable with respect to the drive shaft 20 in the axial direction, i.e., in the widthwise direction (the direction of the arrows B–C) of the sheet. The sleeve 62 and the support 55, the axial movement of which is regulated, can also move with respect to the drive shaft 20 in the direction of the arrows B–C.

The sheet suction operation of the suction unit in the sheet-fed rotary printing press having the above arrangement will be described.

Referring to FIG. 1, after printing, the sheet 7 is gripped by the gripper units of the pair of delivery chains 5 and conveyed to the delivery sheet pile board 8. At the convey terminal end, when the gripped end of the sheet 7 passes the suction wheels 46A to 46E, the sheet 7 travels in slidable contact with the suction wheels 46A to 46E. In this case, in FIGS. 2A and 2B, upon rotation of the motor 21 and drive shaft 20, the respective gears 68 also rotate through the respective sleeves 62 of the suction wheel units 45A to 45E, thereby rotating the suction wheels 46A to 46E. The outer air near the suction wheels 46A to 46E is drawn by the suction air source (not shown) through the suction holes 46*b*. Therefore, the sheet 7 is conveyed as it is attached to the circumferential surfaces of the suction wheels 46A to 46E.

As a result, the speed of the sheet 7 at portions other than its gripped side becomes lower than the convey speed, and the sheet 7 is kept taut in the horizontal state. Accordingly, the traveling inertia of the sheet 7 is attenuated, and the sheets dropped and stacked on the pile board 8 are aligned well.

How to remove non-use suction wheels in accordance with a change in image plate making for the sheet 7 will be described with reference to FIGS. 8A and 8B.

Figure 8A:
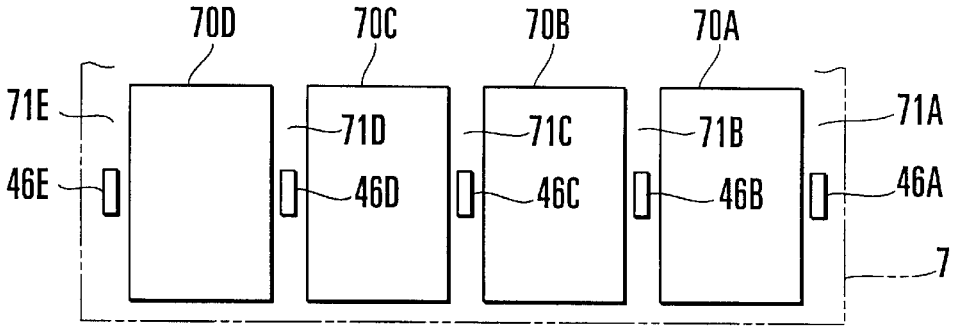
FIGS. 8A and 8B are views for explaining the positions of suction wheels in the case of four-surface printing and two-surface printing, respectively.

Referring to FIG. 8A, when four-surface printing is to be performed to print an image on the sheet 7, four image areas 70A to 70D and five non-image areas 71A to 71E are assigned to the sheet 7. In this case, the suction wheels 46A to 46E are positioned to respectively correspond to the non-image areas 71A to 71E.

Figure 8B:
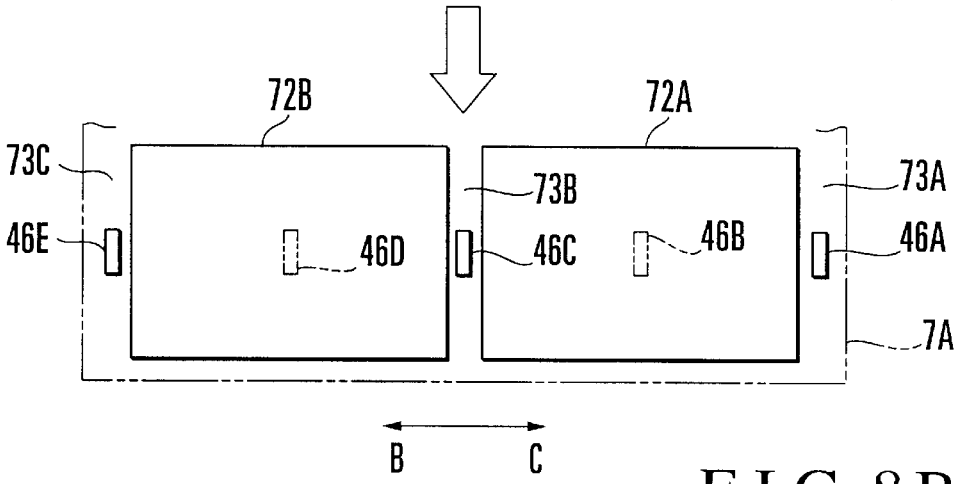

As shown in FIG. 8B, when the number of images in plate making is to be reduced to switch to two-surface printing, two image areas 72A and 72B and three non-image areas 73A to 73C are assigned to a sheet 7*a*. In this case, since the suction wheels 46B and 46D, which have been positioned to correspond to the non-image areas 71B and 71D, correspond to the image areas 72A and 72B, the suction wheels 46B and 46D cannot be used.

To cope with this situation, in FIG. 4, the suction wheels 46B and 46D are removed by rotating the knobs 56 of the screws 57 of the corresponding supports 55 to disengage the screws 57 from the ducts 47, and the suction wheel units 45B and 45D are removed from their supports 55.

When double-sided printing is to be switched to single-sided printing to perform printing on a thick sheet at a high speed, all the suction wheels 46A to 46E are removed by rotating the knobs 56. Instead, wide suction wheels are mounted on the supports 55 of the suction wheel units 45A to 45E by operation reverse to that described above.

According to this embodiment, when image plate making is to be changed, the suction wheels 46B and 46D corresponding to the image areas 72A and 72B can be easily removed by rotating the knobs 56, leading to an improved operability.

When high-speed single-sided printing is to be performed on a thick sheet, a large suction force can be obtained with wide suction wheels. This solves conventional flapping of the trailing end of the sheet, or misalignment of the ends of the stacked sheets occurring due to the traveling inertia which is left when the gripped sheets are released and dropped. In double-sided printing, narrow wheels that can stop sheets at positions matching the image can be mounted. Therefore, slacking of the sheet at the intermediate portion can be prevented.

The suction wheel positioning operation which is performed when the size or image of the sheet 7 is changed will be described with reference to FIGS. 9A and 9B.

Figures 9A, 9B:
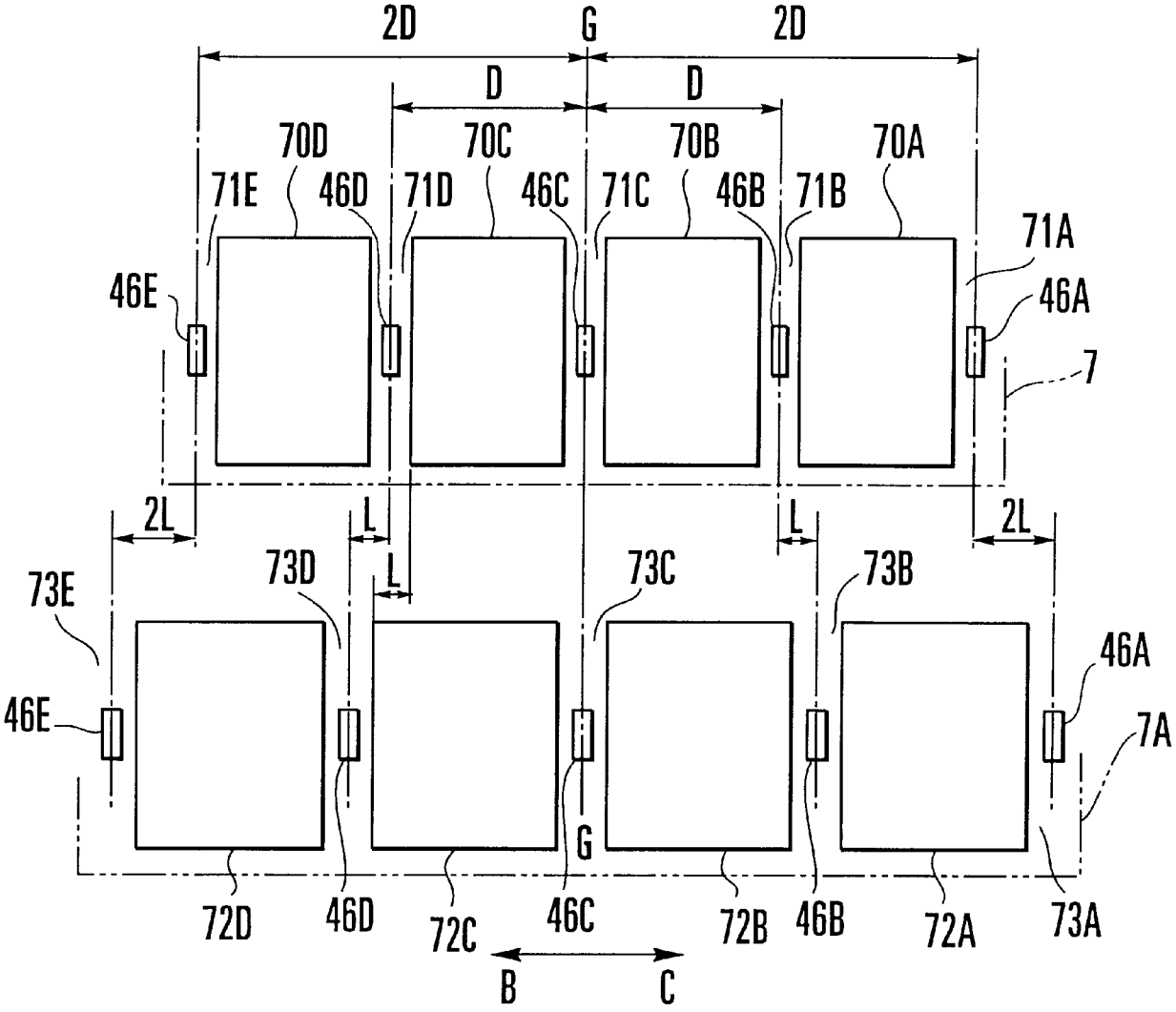
FIGS. 9A and 9B are views for explaining the positions of the suction wheels when the paper size is changed.

Referring to FIG. 9A, image plate making of the sheet 7 is determined as four-surface printing, and the four image areas 70A to 70D and the five non-image areas 71A to 71E are assigned to the sheet 7. The suction wheels 46A to 46E are positioned to correspond to the non-image areas 71A to 71E.

As shown in FIG. 9B, when the size of the sheet 7 is changed to a larger sheet 7A, the widths of image areas 72A to 72D become larger than the widths of image areas 70A to 70D of the sheet 7 by L. In this case, non-image areas 73A, 73B, 73D, and 73E are assigned with a larger span than that of the non-image areas 71A, 71B, 71D, and 71E of the sheet 7 with reference to a center G—G in the widthwise direction of the sheet. More specifically, the non-image areas 73D and 73E are assigned at positions shifted from the non-image areas 71D and 71E, located to the left from the center G—G in the widthwise direction of the sheet, to the left by distances L and 2L, respectively. The non-image areas 73A and 73B are assigned at positions shifted from the non-image areas 71A and 71B, located to the right from the center G—G in the widthwise direction of the sheet, to the right by distances L and 2L, respectively.

The handle 28 is rotated to rotate the operation shaft 27, thereby rotating the first to fourth screw rods 35, 37, 39, and 40 through the connecting shaft 29. The respective supports 55 of the suction wheel units 45A to 45E are supported by the drive shaft 20 through the sleeve 62 to be movable in the direction of the arrows B–C. Thus, when the screw rods 35, 37, 39, and 40 are rotated, the supports 55, the bushes 58 of which threadably engage with the screw rods 35, 37, 39, and 40, move in the direction of the arrows B–C as they are guided by the drive shaft 20.

In this case, the first and second screw rods 35 and 37 located to the right (direction of the arrow C) from the center form right-hand threads, and the third and fourth screw rods 39 and 40 located to the left (direction of the arrow B) from the center form left-hand threads. As the screw rods 35 and 37 rotate, the suction wheel units 45A and 45B move in the direction of the arrow C. Simultaneously, as the screw rods 39 and 40 rotate, the suction wheel units 45D and 45E move in the direction of the arrow B.

The pitches of the first and fourth screw rods 35 and 40 serving as the outer screw rods are twice those of the second and third screw rods 37 and 39 serving as the inner screw rods. When the inner suction wheel units 45B and 45C move by the distance L, the outer suction wheel units 45A and 45E move by the distance 2L. Therefore, all of the suction wheels 46A to 46E are positioned simultaneously to correspond to the non-image areas 73A to 73E of the sheet 7A.

According to this embodiment, since the positions of the counter handle side suction wheel units 45D and 45E are adjusted by operating one handle 28 from the center in the widthwise direction of the sheet 7, the operability can be increased. Since the suction wheel positioning operation is performed by the handle 28 provided to the outside of the suction wheel units, the operability can be better than that of the conventional positioning operation performed inside the suction wheel units.

Suction wheel positioning operation which is performed when the number of images in plate making is changed or plate making is changed to nonuniform plate making will be described.

To change the number of images in plate making from four-surface printing to three-surface printing, the handle 28 is pivoted to move the suction wheel units 45A to 45E to the margins (non-image areas) on the two ends of the sheet. The bolts 54*c* (FIG. 5) of the suction wheel units 45B and 45D are loosened, and the pivotal members 53 are moved to move the suction wheel units 45B and 45D in the sheet widthwise direction (the direction of arrows B–C) separately. After the suction wheel units 45B and 45D are positioned at the margins (non-image areas) inside the sheet widthwise direction, the bolts 54*c* are fastened. Finally, the knobbed screw 57 of the central suction wheel unit 45C is loosened to remove the suction wheel unit 45C from the support 55. As a result, the suction wheel units 45A, 45B, 45D, and 45E are positioned in the non-image areas of the sheet.

Adjusting operation which is performed when the center of a plate (not illustrated) is positionally offset in the sheet widthwise direction will be described. In this case, all of the suction wheels 46A to 46E do not correspond to the non-image areas 71A to 71E of the sheet 7.

First, the set screw 31 (FIG. 2A) is loosened and the head 30*a* of the operation shaft movement adjusting member 30 is rotated with a spanner or the like to move the operation shaft movement adjusting member 30 in the direction of the arrows B–C. By this movement, the connecting shaft 29 is moved in the direction of the arrows B–C through the pair of rings 32, and the screw rods 35, 37, 39, and 40 are also moved at once in the direction of the arrows B–C by the same amount. As a result, the suction wheels 46A to 46E can be positioned in the non-image areas 71A to 71E.

According to this embodiment, the adjusting operation is easy, and the suction wheels 46A to 46E will not erroneously come into slidable contact with the ink of a printed portion, so that the printing quality can be improved.

To adjust movement of the suction wheels 46A to 46E, the positional error amount of the suction wheel 46 on the sheet 7 as the positional error amount of the plate may be set by using the pointer 33 and scale 34. This can decrease the number of times of test printing to decrease the amount of wasted paper. Since the adjusting operation can be performed simply within a short period of time, the productivity is improved.

In the above embodiment, if an air source which can be switched between suction and exhaust is connected to the pipes connected to the suction wheels 46A to 46E, air ducts may be mounted on the supports 55 in place of the suction wheels 46A to 46E. In this case, if air is blown from the air ducts toward the outer side or upper side of the sheet widthwise direction, slacking of the sheet at the intermediate portion can be prevented.

In place of the suction wheels 46A to 46E, suction units having various types of pivotal belts can be mounted on the supports 55. Therefore, the printing press can cope with various types of printing, leading to an improved versatility. The sheet 7 can be any sheet-like printing product including a film.

As has been described above, according to the present invention, since the suction members can be removed from the suction wheel units, a suction member which is not in use can be handled easily. Since another suction member, a paper receiving wheel, and the like can be attached and detached easily, the printing press can cope with various types of printing, leading to an improved versatility. Since the suction members can be rotatably driven with one drive shaft by utilizing the suction holes of the suction surfaces, the structure is simplified.

What is claimed is:

1. A suction unit in a sheet-fed rotary printing press, comprising:

a plurality of suction members provided below a sheet convey path to draw a sheet-like printing product in a slidable contact by suction;

a plurality of support members for supporting said suction members to be movable in a sheet convey direction;

a drive mechanism for driving said suction members in the sheet convey direction;

a fixing member for detachably fixing said suction members to said support members, wherein said suction members are connected to said drive mechanism when said suction members are fixed to said support members by said fixing member and disconnected from said drive mechanism when said suction members are released from said support members;

wherein said suction members each has at least one suction hole for sucking the sheet-like printing product in the sheet convey direction;

wherein said suction members comprise suction wheels each having a circumferential surface formed with a large number of suction holes, said drive mechanism rotatably drives said suction wheels in the sheet convey direction, and said support members rotatably support said suction wheels; and wherein said drive mechanism comprises a drive shaft rotatably driven by a drive source and a gear rotating together with said drive shaft to mesh with said suction holes of said suction wheels, and said suction holes of said suction wheels are formed at the same pitch as that of teeth of said gear.

2. A suction unit in a sheet-fed rotary printing press, comprising:

a plurality of suction members provided below a sheet convey path to draw a sheet-like printing product in a slidable contact by suction;

a plurality of support members for supporting said suction members to be movable in a sheet convey direction;

a drive mechanism for driving said suction members in the sheet convey direction;

a fixing member for detachably fixing said suction members to said support members, wherein said suction members are connected to said drive mechanism when said suction members are fixed to said support members by said fixing member and disconnected from said drive mechanism when said suction members are released from said support members;

a support mechanism for movably supporting said support members in a direction perpendicular to the sheet convey direction, wherein said support mechanism comprises a rotatably supported screw shaft having a first threaded portion, said support members have second threaded portions each threadably engageable with said first threaded portion of said screw shaft, and said support members move in a direction perpendicular to the sheet convey direction upon rotational movement of said screw shaft; and wherein said first threaded portion forms threads in different directions at one side and the other side thereof with respect to a center position of a sheet width in a direction perpendicular to the sheet convey direction as a boundary.

3. A suction unit in a sheet-fed rotary printing press, comprising:

a plurality of suction members provided below a sheet convey path to draw a sheet-like printing product in a slidable contact by suction;

a plurality of support members for supporting said suction members to be movable in a sheet convey direction;

a drive mechanism for driving said suction members in the sheet convey direction;

a fixing member for detachably fixing said suction members to said support members, wherein said suction members are connected to said drive mechanism when said suction members are fixed to said support members by said fixing member and disconnected from said drive mechanism when said suction members are released from said support members;

a support mechanism for movably supporting said support members in a direction perpendicular to the sheet convey direction, wherein said support mechanism comprises a rotatably supported screw shaft having a first threaded portion, said support members have second threaded portions each threadably engageable with said first threaded portion of said screw shaft, and said support members move in a direction perpendicular to the sheet convey direction upon rotational movement of said screw shaft; and wherein said first threaded portion comprises a plurality of male threads formed a predetermined interval in an axial direction of said screw shaft, and said male threads are formed with different pitches in accordance with distances thereof from a center position of a sheet width in a direction perpendicular to the sheet convey direction.

4. A suction unit in a sheet-fed rotary printing press, comprising:

a plurality of suction members provided below a sheet convey path to draw a sheet-like printing product in a slidable contact by suction;

a plurality of support members for supporting said suction members to be movable in a sheet convey direction;

a drive mechanism for driving said suction members in the sheet convey direction;

a fixing member for detachably fixing said suction members to said support members, wherein said suction members are connected to said drive mechanism when said suction members are fixed to said support members by said fixing member and disconnected from said drive mechanism when said suction members are released from said support members;

a support mechanism for movably supporting said support members in a direction perpendicular to the sheet convey direction; and an adjusting mechanism which moves said support mechanism in a direction perpendicular to the sheet convey direction to adjust positions of said suction members.

5. A unit according to claim 4, wherein said suction members each has at least one suction hole for sucking the sheet-like printing product in the sheet convey direction.

6. A unit according to claim 5, wherein said suction members comprise suction wheels each having a circumferential surface formed with a large number of suction holes, said drive mechanism rotatably drives said suction wheels in the sheet convey direction, and said support members rotatably support said suction wheels.

7. A unit according to claim 6, wherein said drive mechanism rotatably drives said suction wheels in the sheet convey direction at a speed lower than a sheet convey speed.

8. A unit according to claim 6, wherein said suction wheels comprise at least a first type of suction wheel having a comparatively narrow circumferential surface and a second type of suction wheel having a comparatively wide circumferential surface, and a type and number of said first and second suction wheels are set in accordance with a printing mode and a number of images in plate making.

9. A unit according to claim 4, wherein said suction members are arranged in a widthwise direction of the printing product.

10. A unit according to claim 4, wherein said support mechanism comprises a rotatably supported screw shaft having a first threaded portion, said support members have second threaded portions each threadably engageable with said first threaded portion of said screw shaft, and said support members move in a direction perpendicular to the sheet convey direction upon rotational movement of said screw shaft.

11. A unit according to claim 4, wherein said support mechanism comprises a shaft supported by a pair of frames, said adjusting mechanism has a moving module being movably supported in a direction perpendicular to the sheet convey direction, and said moving module supports said shaft to be pivotable and regulates the movement of said shaft in a direction perpendicular to the sheet convey direction.

12. A unit according to claim 11, wherein said moving module further comprises:

a cylindrical position adjusting member having an outer circumferential surface engaging threadedly to said frame and a through-hole through which the shaft penetrates; and ring members adhered to said shaft at both ends of said position adjusting member to put said position adjusting member therebetween.

13. A unit according to claim 4, wherein said adjustment mechanism enables the position of said suction members to be collectively adjusted.

* * * * *

UNITED STATES PATENT AND TRADEMARK OFFICE

CERTIFICATE OF CORRECTION

PATENT NO. : 6,264,190 B1
DATED : July 24, 2001
INVENTOR(S) : Aoki

It is certified that error appears in the above-identified patent and that said Letters Patent is hereby corrected as shown below:

Title page,
Item [56], under References Cited, FOREIGN PATENT DOCUMENTS, in the first entry and after "6/1956 (DE) -" please insert -- B41F --.
Please insert the following entries:
-- 25 33755 1/1947 (JP)
25 48897 5/1997 (JP)
7 26288 6/1995 (JP) --.

Signed and Sealed this

Thirtieth Day of July, 2002

*Attest:*

*Attesting Officer*

JAMES E. ROGAN
*Director of the United States Patent and Trademark Office*